United States Patent [19]

Muchiarone

[11] 4,104,639

[45] Aug. 1, 1978

[54] ANTENNA FORMED OF TWO CLOSELY COUPLED LINEAR CONDUCTORS WITH HELICAL TOP LOADING

[75] Inventor: Jerome J. Muchiarone, Anderson, S.C.

[73] Assignee: True Temper Corporation, Cleveland, Ohio

[21] Appl. No.: 727,861

[22] Filed: Oct. 4, 1976

[51] Int. Cl.[2] ..... H01Q 1/32; H01Q 9/36

[52] U.S. Cl. ..... 343/723; 343/752; 343/900

[58] Field of Search ..... 343/749, 750, 752, 895, 343/723, 900

[56] References Cited

U.S. PATENT DOCUMENTS

| | | | |
|---|---|---|---|
| 3,099,010 | 7/1963 | Taylor | 343/749 |
| 3,172,109 | 3/1965 | Senrui | 343/749 |
| 3,400,403 | 9/1968 | Spilsbury | 343/752 |
| 3,774,221 | 11/1973 | Francis | 343/895 |

*Primary Examiner*—Eli Lieberman

*Attorney, Agent, or Firm*—J. H. Slough

[57] ABSTRACT

A radio frequency antenna comprising a shaft fabricated from dielectric material, and first and second conducting means disposed on the exterior surface of the shaft, the conducting means including linear conductors located on opposite sides of one portion of the shaft and intertwined insulated coils on a second portion of the shaft connected to the respective linear conductors. Tuning members can be connected to the conducting means for selectively changing the resonant frequency of the antenna.

9 Claims, 8 Drawing Figures

ANTENNA FORMED OF TWO CLOSELY COUPLED LINEAR CONDUCTORS WITH HELICAL TOP LOADING

Figures 1, 1A, 2, 2A, 3, 3A, 4, 5:
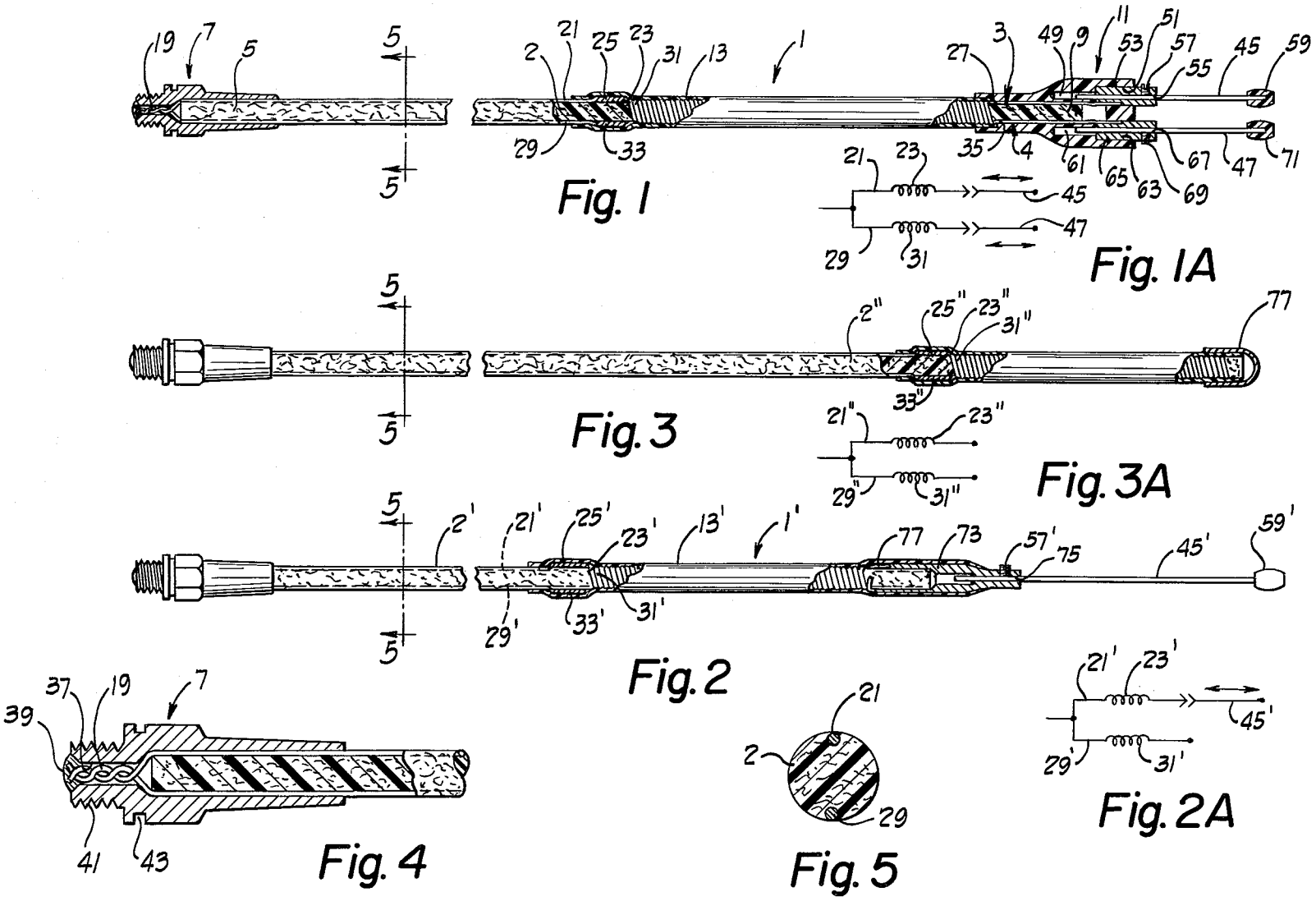

The present invention relates to antenna structure of the generally freestanding type particularly adapted for use with mobile transmitter-receiver installations, such as are used for citizens band operation in connection with motor vehicles.

Antennas of the present type should meet various electrical criteria in order to render the antennas acceptable for their intended use. Therefore, it is common to provide such antennas with an electrical length of a quarter wavelength since end-fed antennas of such length approach resonance. Furthermore, since antennas of this type are conventionally connected to coaxial cables having a characteristic impedance (normally 52 ohms), it is desirable to match the terminal impedance of the antenna with the impedance of the coaxial cable to obtain maximum power transmission. U.S. Pat. No. 3,774,221 is directed to an antenna structure having electrically connected linear and helical conducting elements embedded in or near the core of a composite antenna, the antenna having an impedance according to the foregoing matching criteria.

Antennas of the present type should additionally meet various physical criteria. These antennas are normally upstanding, being connected at their base end to a motor vehicle and having a free tip end. Such antennas are normally subjected to substantial and varying dynamic loads caused largely by the movement of the motor vehicle and the resulting wind resistance. Therefore, the antenna should be strong and flexible. Various resinous and fiberglass antenna constructions are known which are intended to satisfy these physical criteria. U.S. Pat. No. 3,541,567 discloses an antenna structure formed from a solidified matrix of synthetic resin having embedded therein a multiplicity of elongated electrical conductors. A metallic mounting ferrule is provided with a central socket in which an end of the antenna structure is inserted, and the ends of the conductors extend through an aperture in the core and are soldered to the ferrule. U.S. Pat. No. 3,774,221, noted previously, has a synthetic resin matrix body intended to have mechanical characteristics relating to flexural strength and modulus to withstand the static and dynamic loads that may be encountered in vehicle installations. The latter matrix is described as comprising a thermosetting polyester or epoxy and includes strands of fiberglass distributed throughout the body. Commonly assigned co-pending U.S. Ser. No. 664,866 filed Mar. 8, 1976 in the name of Jerome J. Muchiarone, discloses an antenna structure having an elongated body and an electrically conductive linear element exteriorly disposed on the body for electrical connection with a conductive coil similarly disposed on the body, the structure further including a plastic sleeve encasing the coil element. Not only is the latter construction particularly effective in use, but it substantially facilitates the manufacture of such antennas since the conducting elements are disposed on the surface of the antenna.

The great popularity of citizens band receiving and transmitting radio systems and the associated increase in the number of channels over which messages can be transmitted and received, has made the development of antennas having improved electrical and mechanical characteristics particularly desirable. Furthermore, the desirability of providing means for tuning such antennas to control the resonant frequency thereof is similarly increased.

It is an object of the present invention to provide an improved radio frequency antenna.

Another object of the invention is to provide a radio frequency antenna having improved mechanical and electrical characteristics.

Still another object of the invention is to provide a radio frequency antenna of the foregoing type having a high power transmission.

Yet another object of the invention is to provide a radio frequency antenna whose resonant frequency can easily be tuned.

Still another object of the invention is to provide an antenna of the foregoing types which can easily be manufactured.

An additional object of the invention is to provide an improved radio frequency antenna which is efficient and effective in operation.

Other objects will be apparent from the description to follow and from the appended claims.

The foregoing objects are achieved according to the preferred embodiments of the invention by the provision of an antenna comprising an elongated shaft of dielectric material, and first and second conducting means electrically connected to each other at the base end of the shaft and insulated from each other elsewhere in the antenna. The first and second electrical conducting means each comprise a generally linear conductor disposed on one portion of the shaft such as the portion adjacent the base of the shaft, and a coil wrapped around another portion of the shaft such as the portion adjacent the trip end of the shaft. The two coils collectively comprise a double-wound coil and occupy the same portion of the shaft, and the coils are electrically connected to the respective linear conductors. A dielectric film covers the coil conductor portion of the antenna, and a ferrule is provided at the tip end of the antenna. Movable tuning members electrically connected to the conducting means can be provided at the tip end of the antenna for selectively changing the resonant frequency of the antenna.

FIGS. 1 through 3 are elevational views of three embodiments of the invention with portions cut away to reveal the internal construction of the respective antennas, and FIGS. 1A through 3A are electrical schematic representations of the respective embodiments;

FIG. 4 is a detailed, elevational view of the base portion of any of the antennas illustrated in FIGS. 1 through 3, with a portion cut away for the purpose of clarity; and FIG. 5 is a cross-sectional view of a portion of any of the antennas shown in FIGS. 1 through 3, taken in the direction of the arrows 5—5.

The embodiments of the invention described below each pertain to a top loaded radio-frequency antenna particularly adapted for vertical mounting on a motor vehicle. The antennas include a shaft or body fabricated from a dielectric material having substantial strength and flexibility such as fiberglass, and first and second conducting means disposed on the exterior surface of the shaft. These conducting means are connected together at the base end of the shaft, and respectively include a linear portion adjacent the base end of the shaft and a coil portion connected to the respective linear portions adjacent the tip end of the shaft. The coil portions collectively comprise a double-wound or bifilar coil. Two of the embodiments described below have movable tuning elements at the tip end of the antenna for selectively changing the resonant frequency of the antenna.

Turning now to FIG. 1, an antenna 1 is shown which comprises a shaft 2, a first conducting means 3, and a second conducting means 4. Shaft 2 has a base portion 5 which is fixed in a base ferrule 7, and a tip portion 9 which is fixed in a tip ferrule 11. Conducting means 3 and 4 are disposed on the exterior surface of shaft 2, and film sleeve 13 of dielectric material covers the exterior surface of the shaft including the coil portions of conducting means described below. The latter sleeve can advantageously be a thin plastic tube which is applied by an appropriate shrinking process. Conducting means 3 and 4 are electrically connected at the base portion of the antenna as indicated by the intertwined relationship designated by the numeral 19 in FIGS. 1 and 4, and are insulated from each other elsewhere on the antenna.

Conducting means 3 and 4 have similar constructions. Thus, first conducting means 3 comprises a first linear conductor 21 disposed on the surface of a first portion of shaft 3 adjacent the base end of the antenna, and a first coil 23 electrically connected to conductor 21 by an appropriate splice and solder connection as indicated by the numeral 25. Coil 23 is a helical coil which, as explained below, comprises part of a double or bifilar coil extending from the connection with linear conductor 21 to the tip end of the antenna. Coil 23 can advantageously terminate at the tip end of the antenna in a short linear portion 27. Second conducting means 4 comprises corresponding elements 29, 31, 33 and 35. Linear portions 21 and 29 of the respective conducting means are disposed on opposite sides of dielectric shaft 3, and coils 23 and 31 collectively form the double coil mentioned above. The coils are insulated from each other by means of an insulating coating on at least one of the two coils. End portions 29 and 35 of portions 23 and 31 are disposed on opposite sides of shaft 3.

Base ferrule 7 can be of known construction and can conveniently comprise a chrome-plated brass ferrule. Connected portions 19 of the respective conducting means extend through a central bore 37 in ferrule 7, and are sealed in place by a solder connection 39. Ferrule 7 has external screw threads 41 and an annular groove 43 for mounting the antenna in a vertical position in an appropriate aperture on a motor vehicle.

A pair of tuning members 45 and 47 are provided at the trip end of the antenna for selectively varying the resonant frequency of the antenna. Members 45 and 47 are mounted for sliding contact with the respective conducting means in tip ferrule 11 and cooperating elements. Accordingly, ferrule 11 includes a recess 49 having a dead end and a narrow bore, and a coaxial recess 51 having an expanded bore. A conducting insert or support 53, which is preferably a chrome-plated brass knurled insert having a central bore 55, is seated on the shoulder between the recesses 49 and 51. Bore 55 is dimensioned to receive tuning member 45 in sliding engagement, and a set screw 57 extends through insert 53 in a transverse direction to bore 55. Set screw 57 can be tightened to retain tuning member 45 in any selected position, and when released, permits the adjustment of tuning member 45. Insert 51 is disposed in contact with end 27 of first conducting means 3, so that tuning member 45 is electrically connected to the latter conducting means. In order to assure this electrical contact, it is desirable to solder end 27 to insert 51. Tuning member 45 can conveniently be fabricated from a straight steel wire, and a plastic bead 59 can be bonded to the free end of the tuning member to cover the otherwise pointed end thereof.

Tuning member 47 is electrically connected to end 35 of second conducting means 4. The structure associated with the mounting of tuning member 47 corresponds to similarly designated elements associated with tuning member 45, and includes a recess 61, a coaxial expanded recess 63, a conducting insert 65 having a bore 67 for receiving tuning member 47, a set screw 69 and a protective bead 71. Tuning members 45 and 47 can be independently moved to lengthen or shorten the respective conducting means 3 and 4 to change the resonant frequency of the antenna. FIG. 1A shows the electrical elements of antenna 1 in schematic form.

The antenna shown in FIG. 2 has the same general configuration as antenna 1, with the exception that only a single tuning member is provided. Accordingly, the portions of the antenna shown in FIG. 2 which correspond to like portions of antenna 1 are given the same numerical designator with a prime (') suffix. The tip ferrule 73 of antenna 1' is a chrome-plated brass ferrule having a central bore 75 for receiving tuning member 45'. A solder connection 77 connects ferrule 73 to the end of only the first conducting means, ferrule 73 being insulated from the other conducting means. The electrical construction of antenna 1' is shown schematically in FIG. 2A.

A simpler version of the invention is shown in FIG. 3 wherein there are no tuning members. Portions of the antenna shown in FIG. 3 which correspond to like portions of the antenna shown in FIG. 1 are given the same numerical designators with a double prime (") suffix. The tip ferrule 77 of antenna 1" merely comprises a dielectric cap as shown. An electrical schematic diagram of antenna 1" is shown in FIG. 3A.

The respective conducting means have been described as being disposed on the exterior surface of the antenna shaft. In describing this arrangement, it is intended that the conducting means be disposed outwardly of the outermost surface of the shaft or, as shown in FIG. 5, adjacent to that surface, (in each case, irrespective of the dielectric sleeve). Referring to FIG. 5, the conducting means and shaft have been indicated by the numerical designators of FIG. 1, but it is intended that the cross section reflect the constructions of the other embodiments described herein.

The foregoing embodiments of the invention indicate the achievement of the objects set forth eariler. A radio frequency antenna has been described having improved mechanical and electrical characteristics. The antenna has a high power transmission. Two of the embodiments provide means for easily adjusting the resonant frequency of the antenna. In this regard, it is significant that the tuning elements can be easily adjusted and, if necessary, replaced. The antennas described above are efficient and effective in operation and economical to manufacture.

The invention has been described in detail with particular reference to preferred embodiments thereof, but it will be understood that variations and modifications within the spirit and scope of the invention may occur to those skilled in the art to which the invention pertains.

I claim:

1. A radio frequency antenna comprising:

an elongated shaft of dielectric material, said shaft having a base end, a tip end, and an exterior surface between the base and tip ends; and first and second electrical conducting means electrically connected to each other at the base end of the antenna and electrically insulated from each other at the tip end of the antenna, said conducting means comprising:

first and second generally linear conductors electrically insulated from each other and extending along opposite sides of the exterior surface of a first portion of the shaft; and first and second conducting coils electrically insulated from each other and extending around the exterior surface of a second portion of the shaft, said first and second coils being electrically connected to said first and second linear conductors, respectively, to form said first and second conducting means; and first tuning means electrically connected to one of said first and second conducting means, said first tuning means being selectively movable relative to said one conducting means for changing the resonant frequency of the antenna.

2. The invention according to claim 1 wherein said dielectric material comprises fiberglass.

3. The invention according to claim 1 wherein said first and second conducting coils are intertwined to form a doublewound coil wound about the same section of said shaft.

4. The invention according to claim 1 and further comprising:

a ferrule having support means for receiving said first tuning means in sliding engagement while maintaining electrical connection between said first tuning means with said one conducting means.

5. The invention according to claim 1 and further comprising:

second tuning means electrically connected to the other of said first and second conducting means at the tip end of the antenna, said first and second tuning means being selectively movable relative to the respective conducting means for changing the resonant frequency of the antenna.

6. The invention according to claim 5 and further comprising:

a ferrule having support means for receiving said first and second tuning means in sliding engagement while maintaining the electrical connection of said tuning means with the respective conducting means.

7. The invention according to claim 1 and further comprising a ferrule of dielectric material at the tip end of the antenna for covering said tip end and for insulating said first and second conducting means from each other at said tip end.

8. The invention according to claim 1 and further comprising a dielectric film covering the exterior surface of said shaft for protecting said first and second conducting coils.

9. The invention according to claim 1 wherein said first portion of the shaft is disposed adjacent the base end of the shaft, and said second portion of the shaft is disposed adjacent the tip end of the shaft.

* * * * *